United States Patent [19]

Heider

[11] Patent Number: 4,516,364

[45] Date of Patent: May 14, 1985

[54] INSULATING BLOCK AND A WALL THEREOF

[76] Inventor: Richard M. Heider, 8002 E. del Tesoro Dr., Scottsdale, Ariz. 85258

[21] Appl. No.: 430,967

[22] Filed: Sep. 30, 1982

[51] Int. Cl.[3] ..... E04C 1/00; E04C 1/10

[52] U.S. Cl. ..... 52/98; 52/591; 52/593

[58] Field of Search ..... 52/593, 595, 309.4, 52/309.2, 98, 594, 99, 100, 591; 446/125, 128

[56] References Cited

U.S. PATENT DOCUMENTS

| | | | |
|---|---|---|---|
| 1,700,542 | 1/1929 | O'Donnel | 52/98 |
| 2,047,154 | 7/1936 | Pismer | 52/404 |
| 2,727,382 | 12/1955 | Kurz | 52/98 |
| 3,116,570 | 1/1964 | Torricelli | 52/591 |
| 3,148,477 | 9/1964 | Bjorn et al. | 52/591 |
| 3,788,020 | 1/1974 | Gregori | 52/309.12 |
| 3,895,469 | 7/1975 | Kapitan | 52/595 |
| 4,018,018 | 4/1977 | Kosuge | 52/309.4 |
| 4,044,520 | 8/1977 | Barrows | 52/309.12 |
| 4,117,641 | 10/1978 | Wells | 52/404 |
| 4,126,979 | 11/1978 | Hancock | 52/593 |
| 4,158,939 | 6/1979 | Massin | 52/594 |
| 4,297,816 | 11/1981 | Kella et al. | 52/221 |

FOREIGN PATENT DOCUMENTS

| | | | |
|---|---|---|---|
| 171882 | 7/1952 | Austria | 52/590 |
| 815691 | 8/1951 | Fed. Rep. of Germany | 52/594 |
| 1086423 | 8/1960 | Fed. Rep. of Germany | 52/594 |
| 2926836 | 1/1980 | Fed. Rep. of Germany | 52/593 |
| 1245810 | 10/1960 | France | 52/594 |
| 466266 | 10/1951 | Italy | 52/98 |
| 166623 | 7/1921 | United Kingdom | 52/593 |
| 961135 | 6/1964 | United Kingdom | 52/309.4 |
| 1136570 | 12/1968 | United Kingdom | 52/309.2 |

*Primary Examiner*—John E. Murtagh
*Assistant Examiner*—Andrew Joseph Rudy
*Attorney, Agent, or Firm*—Weiss & Holloway

[57] ABSTRACT

A generally rectangular insulating block presenting parallel and opposite upper and lower surfaces and end and side portions thereof. A first series of matching dovetail mortises and tenons are provided on the end portions with a second series on the side portions. The mortises and tenons provide for interlocking of adjacent blocks in a particular wall course. A plurality of regularly spaced sockets are formed in the bottom surface of the block into which may be frictionally engaged a like plurality of regularly spaced posts on the top surface of subjacent blocks in a lower wall course. Additionally provided is an insulating wall including at least two of the insulating blocks of the present invention angular in superimposed courses of interlocking adjacent blocks.

10 Claims, 5 Drawing Figures

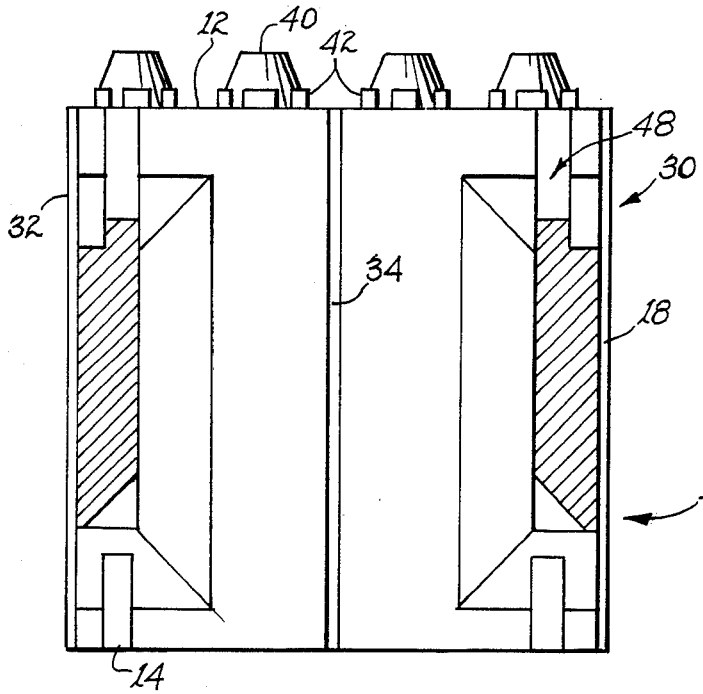
fig. 3
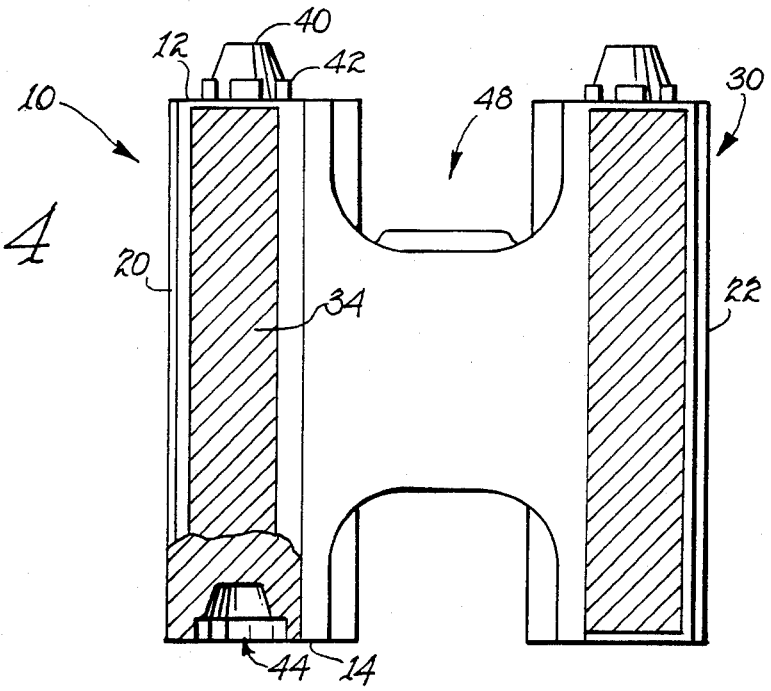
fig. 4
fig. 5
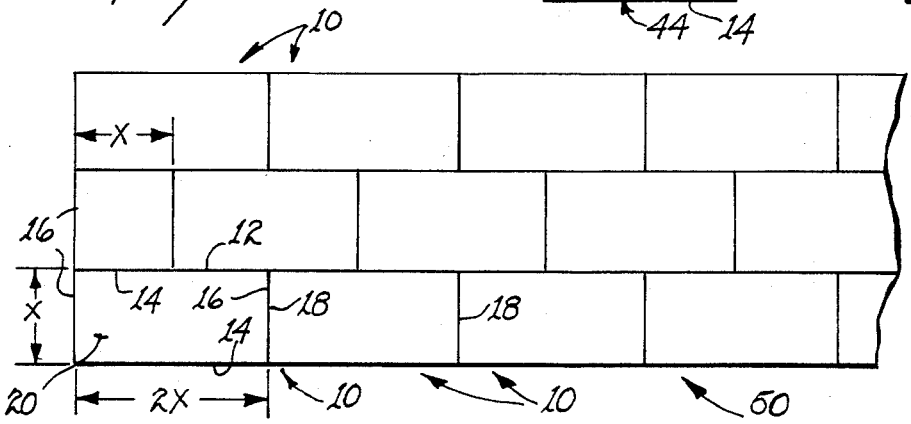

INSULATING BLOCK AND A WALL THEREOF

BACKGROUND OF THE INVENTION

The present invention relates to insulating components and structures. More particularly, the present invention relates to an insulating block which may be readily interlocked with a plurality of like insulating blocks and sectioned to form an insulating wall of superimposed courses of adjacent block.

Previously, it has been known to provide an insulating panel for high or low temperature insulation of a structure. Such a panel comprising a metallic wall is described in U.S. Pat. No. 2,047,154 issued to Carl J. Pimsner. U.S. Pat. No. 4,044,520 issued to Albert G. Barrows describes another building panel of expanded polystyrene comprising a system of interfitting, shiplapped panels. A thermal insulation system for a building is further described in U.S. Pat. No. 4,117,641 issued to David L. Wells including board like insulation elements spanning a space between adjacent building purlins.

A block like insulation system is described, for example, in Swiss Pat. No. 616,981 issued to Manfred Bruer. An insulating block and wall is therein described comprising a plurality of interlocking superimposed courses of the block. However, it is necessary with the block therein disclosed to insert one of two different filler pieces at the block ends at a wall corner such that the finished wall presents a planar and generally complete insulating structure. Further, adjacent blocks in any particular course do not interlock with each other thereby resulting in lesser structural integrity in the finished wall while allowing for the possibility of gaps therebetween to the detriment of its overall insulating properties.

It is therefore an object of the present invention to provide an improved insulating block and wall thereof.

It is further an object of the present invention to provide an improved insulating block and a wall thereof which is readily constructed and requires no filler pieces at a block end adjacent a wall corner.

It is still further an object of the present invention to provide an improved insulating block and a wall thereof in which adjacent blocks of a particular wall course may be interlocked resulting in enhanced structural integrity.

It is still further an object of the present invention to provide an improved insulating block and a wall thereof in which gaps between adjacent blocks of a particular wall course are obviated resulting in increased insulating properties of the structure.

SUMMARY OF THE INVENTION

The aforementioned objects are achieved in the present invention wherein is provided a generally rectangular insulating block presenting parallel and opposite upper and lower surfaces and end and side portions thereof. A first series of matching dovetail mortises and tenons are provided on the end portions with a second series an the side portions. The mortises and tenons provide for interlocking of adjacent blocks in a particular wall course. A plurality of regularly spaced sockets are formed in the bottom surface of the block into which may be frictionally engaged a like plurality of regularly spaced posts on the top surface of subjacent blocks in a lower wall course.

Additionally provided is an insulating wall including at least two of the insulating blocks of the present invention arranged in superimposed courses of interlocking adjacent blocks.

BRIEF DESCRIPTION OF THE DRAWINGS

The abovementioned and other features and objects of the invention and the manner of attaining them will become more apparent and the invention itself will be best understood by reference to the following description of an embodiment of the invention taken in conjunction with the accompanying drawings, wherein:

FIG. 3 is a sectional view of the insulating block of FIG. 1 taken substantially along section line 3—3;

FIG. 4 is a sectional view of the insulating block of FIG. 1 taken substantially along section line 4—4; and FIG. 5 is a partial side elevational view of a wall mode of a plurality of the insulating blocks of FIG. 1 showing a manner of interlocking adjacent blocks and superimposed courses.

DESCRIPTION OF A PREFERRED EMBODIMENT

Figure 1:
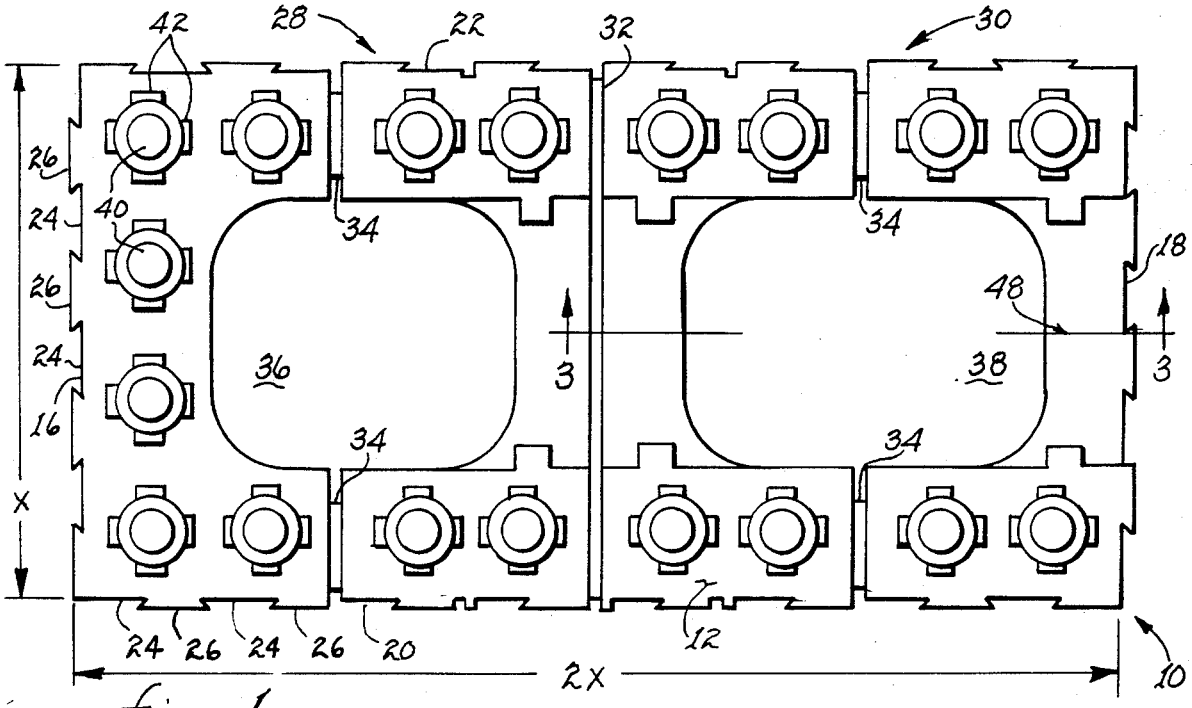
FIG. 1 is a top plan view of an insulating block according to the present invention illustrating the central and offset bores thereof as well as a plurality of regularly spaced posts on the upper surface thereof for interlocking to a superimposed course of the blocks and showing the mortises and tenons on the side and end portions for interlocking to an adjacent block in a particular wall course.
Figure 2:
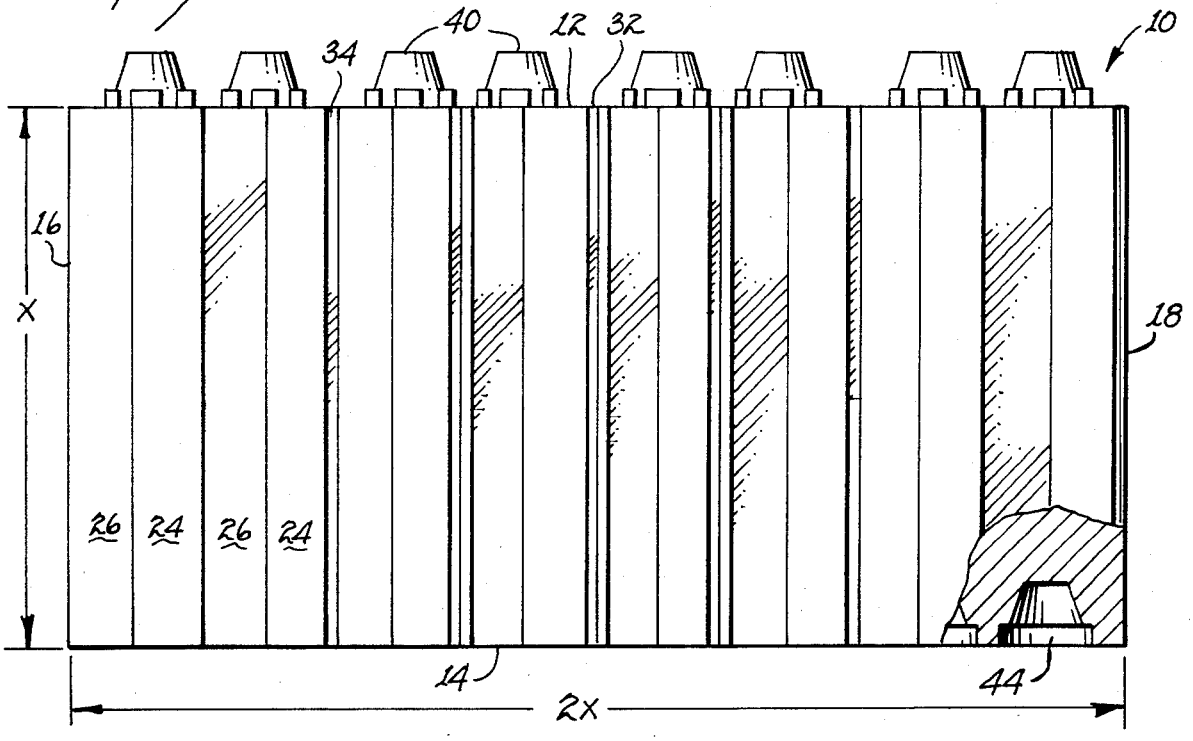
FIG. 2 is a side elevational view of the insulating block of FIG. 1 having a corner of one side portion partially cut away to illustrate one of the plurality of sockets for frictionally engaging a post of a subjacent insulating block.

Referring now to FIGS. 1–4, an insulating block 10 according to the present invention is shown. Insulating block 10, as disclosed, may be conveniently and economically formed of expanded rigid polystyrene or other suitable insulating material capable of being appropriately molded or formed.

Insulating block 10 is of a general rectangular block shape presenting parallel and opposite upper and lower surfaces 12 and 14 respectively; closed and open end portions 16 and 18 respectively; and side portions 20 and 22. Proportionately, side portions 20, 22 are twice the length (2X) of closed and open end portions 16 and 18(X). The height of insulating block 10 between upper and lower surfaces 12 and 14 is also approximately $\frac{1}{2}$ the length (x) of side portions 20 and 22.

Extending vertically between upper surface 12 and lower surface 14 on closed end portion 16, open end portion 18 and side portions 20 and 22 are a series of dovetail mortises 24 and matching tenons 26. Mortises 24 and tenons 26 allow the interlocking of insulating block 10 to an adjacent insulating block 10 in a wall course.

As depicted, it is apparent that an insulating block 10 of the present invention may be interlocked to an adjacent insulating block 10 in either a parallel or perpendicular relationship thereto. That is, a series of insulating blocks 10 of a particular wall course may be interlocked closed and portion 16 to open end portion 18 or in another end to end configuration. Additionally, insulating blocks 10 may be interlocked at closed end portion 16 or open end portion 18 to either of side portions 20, 22 of an adjacent insulating block 10 at either closed half 28 or open half 30.

A partition 32 separates closed half 28 from open half 30 and facilitates the severance of insulating block 10 into two generally equal halves. Breakaparts 34 allow either closed half 28 or open half 30 to be individually bisected such that insulating block 10 may be conveniently quartered if necessary in the construction of a wall.

As illustrated, insulating block 10 also includes an offset bore 36 and central bore 38 communicating between upper and lower surfaces 12 and 14 respectively. Offset bore 36, in conjunction with closed half 28, and central bore 38, in conjunction with open half 30, provide a means for lightening the structural weight of insulating block 10 while providing a dead air space between side portions 20 and 22. Further, offset bore 36 and central bore 38 allow for a reinforcing member to be included in a finished wall through overlapping courses of insulating blocks 10 in an insulating wall 50 as shown additionally in FIG. 5. An aperture 48 is provided communicating between central bore 38 and open end portion 18 to provide access to central bore 38 as well as offset bore 36. Closed end portion 16 allows for a generally continuous planar surface at the corner of an insulating wall 50 as shown in FIG. 5.

Insulating block 10 also includes means for interlocking superimposed course of insulating blocks 10 in the construction of an insulating wall 50. Such means includes a plurality of regularly spaced posts 40 having radially outwardly extending ribs 42 formed on upper surface 12. Posts 40, in conjunction with ribs 42 frictionally engage sockets 44 in the lower surface 14 of a superimposed course of insulating blocks 10.

While a particular insulating wall 50 has been illustrated as to the interrelation of a plurality of insulating blocks 10, is should be apparent that the insulating block 10 of the present invention admits of a multitude of construction techniques. The insulating wall 50 of the present invention may be used in conjunction with existing or other structural material or, depending upon the material chosen, be finished itself to provide a desired structure. It is readily seen that the insulating block 10 and insulating wall 50 disclosed herein provides an improved construction element and structure which can be economically constructed with a minimum of effort. Additionally, no filler pieces are needed at the corners of a wall structure. Importantly, adjacent ones of the insulating block 10 herein disclosed interlock in a given wall course to provide enhanced structural rigidity and greatly reducing possible air gaps therebetween.

While there have been described above the principles of the invention in conjunction with specific apparatus, it is to be clearly understood that this description is made only by way of example and not as a limitation to the scope of the invention.

What is claimed is:

1. A generally rectangular insulating block presenting parallel and opposite upper and lower surfaces and end and side portions thereof, comprising:

a first series of matching dovetail mortises and tenons on said end portions;

a second series of said matching dovetail mortises and tenons on said side portions, said mortises and tenons for interlocking to an adjacent insulating block in a wall course;

a plurality of regularly spaced sockets formed in said bottom surface, each of said sockets having a central cavity surrounded by radially extending grooves;

a like plurality of regularly spaced posts on said top surface, each of said posts having a central projection surrounded by radially extending ribs for frictionally engaging said central cavity and surrounding radially extending grooves of one of said plurality of sockets in another insulating block of a superimposed wall course;

a pair of spaced apart bores communicating between said upper and lower surfaces;

first means extending around the outside of said block for facilitating the lateral bisecting of said block into generally equal size halves; and second means for facilitating the lateral bisecting of said generally equal size halves into generally equal size quarters.

2. The insulating block of claim 1 wherein the length of said side portions is about twice the height of said end portions.

3. The insulating block of claim 1 wherein said block is constructed of expanded rigid polystyrene.

4. The insulating block of claim 1 wherein said first means for facilitating the lateral bisecting of said block comprises a grooved segment having cavities communicating between said side portions and said upper and loweer surfaces.

5. The insulating block of claim 4 wherein said second means for facilitating the lateral bisecting of said generally equal size halves comprises two grooved segments operably positioned in each of said generally equal size halves, each of said grooved segments having cavities communicating between one of said side portions, said upper and lower surfaces and an inside surface of one of said bores.

6. An insulating wall including at least two generally rectangular insulating blocks arranged in superimposed courses, each of said insulating blocks having parallel and opposite upper and lower surfaces and end and side portions thereof, said blocks comprising:

a first series of matching dovetail mortises and tenons and said end portions;

a second series of said matching dovetail mortises and tenons on said side portions, said mortises and tenons for interlocking said blocks in a wall course;

a plurality of regularly spaced sockets formed in said bottom surface, each of said sockets having a central cavity surrounded by radially extending grooves;

a like plurality of regularly spaced posts on said top surface, each os said posts having a central projection surrounded by radially extending ribs for frictionally engaging said central cavity and surrounding radially extending grooves of one of said plurality of sockets in another of said blocks in one of said superimposed courses;

a pair of spaced apart bores communicating between said upper and lower surfaces;

first means entending around the outside of said block for facilitating the lateral bisecting of said block into generally equal size halves; and second means for facilitating the lateral bisecting of said generally equal size halves into generally equal size quarters.

7. The insulating wall of claim 6 wherein the length of said side portions is about twice the height of said end portions.

8. The insulating wall of claim 6 wherein each of said blocks is constructed of expanded rigid polystyrene.

9. The insulating wall of claim 6 wherein said first means for facilitating the lateral bisecting of said blocks comprises a grooved segment having cavities communicating between said side portions and said upper and lower surfaces.

10. The insulating wall of claim 9 wherein said second means for facilitating the lateral bisecting of said generally equal size halves comprises two grooved segments operably positioned in each of said generally equal size halves, each of said grooved segments having cavities communicating between one of said side portions, said upper and lower surfaces and an inside surface of one of said bores.

* * * * *